US006724904B1

(12) United States Patent
Winter

(10) Patent No.: US 6,724,904 B1
(45) Date of Patent: Apr. 20, 2004

(54) MICROPHONE MOUNTING ASSEMBLY

(76) Inventor: Shraga Winter, Rua Bandierantes 289, São Paulo, SP 01124-010 (BR)

( * ) Notice: Subject to any disclaimer, the term of this patent is extended or adjusted under 35 U.S.C. 154(b) by 396 days.

(21) Appl. No.: 09/608,025

(22) Filed: Jun. 30, 2000

(51) Int. Cl.[7] ..... H04R 25/00

(52) U.S. Cl. ..... 381/361; 381/355; 381/359; 381/363; 181/178; 181/179; 181/180; 181/190; 181/197

(58) Field of Search ..... 381/87, 384, 361, 381/368, 385, 366, 362, 363, 355, 358, 359; 181/180, 158, 178, 179, 190, 197, 210; 248/688, 689, 693, 558, 564, 567, 584, 595, 589, 642, 643, 649, 678, 450, 511, 514, 519, 525, 528, 535, 121

(56) References Cited

U.S. PATENT DOCUMENTS 2,263,668 A * 11/1941 Woodworth
3,324,254 A * 6/1967 Shaw
4,194,096 A 3/1980 Ramsey
4,396,807 A 8/1983 Brewer
4,514,598 A 4/1985 Plice
4,767,231 A * 8/1988 Wallis
4,791,674 A 12/1988 Drever
4,811,405 A 3/1989 Peiker
4,872,630 A * 10/1989 Cooper
4,991,220 A 2/1991 Wolf
5,322,255 A * 6/1994 Garrett
5,454,042 A * 9/1995 Drever
6,480,613 B1 * 11/2002 Choi

* cited by examiner

*Primary Examiner*—Curtis Kuntz
*Assistant Examiner*—Dionne Harvey
(74) *Attorney, Agent, or Firm*—Malloy & Malloy, P.A.

(57) ABSTRACT

A mounting assembly for removably supporting a microphone in an operative position and in a manner which will protect the microphone against attenuating high impact phonetic peaks. A plurality of support assemblies are selectively attachable to one another to assume a variety of predetermined individually selectable configurations, wherein each of the predetermined configurations are determinative of a preferred operative orientation of the microphone. The plurality of support assemblies include a microphone support structured, to suspend the microphone in a predetermined orientation; a filter support structured, to adjustably support a filter in a substantially aligned, protective relation to the microphone; and an auxiliary support, structured to be removably and adjustably attached in supporting relation to at least one of said filter or microphone supports. Each of said microphone, filter and auxiliary supports comprises at least one elongated base and at least one connector movably mounted to slide along a length of a corresponding base. The connectors are further structured to removably interconnect correspondingly positioned bases to one another to assume anyone of the aforementioned plurality of predetermined configurations, as well as the selective operative orientation of the microphone.

27 Claims, 6 Drawing Sheets

MICROPHONE MOUNTING ASSEMBLY

BACKGROUND OF THE INVENTION

1. Field of the Invention

An assembly for the removable mounting and support of one or more microphones, each of which may have a different dimension and configuration and which are operatively positioned in a manner which suppresses the mechanical and phonetic noise, to which the one or more microphones may be subjected, as well as attenuates high impact phonetic peaks. The mounting assembly comprises a plurality of support assemblies including at least a microphone support, filter support and auxiliary support, at least one of which has an articulated construction so as to facilitate the selective attachment and positioning of the support assemblies relative to one another in a variety of predetermined configurations, each of which may define a preferred operative orientation of the microphone.

2. Description of the Related Art

In the presentation of a large variety of different types of performances, wherein the sound portion of the performance is electronically enhanced through the utilization of one or more microphones, it is common practice to support the microphones by means of a variety of substantially conventional stands, booms or like support structures. These known support structures typically have one common disadvantage in that when either the microphone or the support structure is inadvertently contacted or jarred, the microphone normally suffers from noise generation and a resulting sound distortion, as well as possible physical damage. Despite repeated attempts to improve the design, dimension, configuration, etc. of known microphone holders or supports, numerous ones of such supports are still subject to the above described deficiency.

The inability to effectively suppress external noise resulting from contact or environmental vibration is further compounded by the fact that microphone technology has advanced to the point where modern day microphones include vastly improved sensitivity and response characteristics. Such advancements in microphone technology is further emphasized by the fact that isolation of modern, dynamic microphones from mechanical vibration is essential to maximize their use and performance. Attempts to accomplish this needed isolation has resulted in the development of internal damping mechanisms, enhanced by external shock mounting apparatus. By and large, the latter category of devices have become more popular because external shock mounting apparatus is frequently more compatible with various types of microphones, without requiring the change of the microphone's internal structure. However, in spite of at least some improvement in microphone support structures, particularly in the area of external shock mounting apparatus, various deficiencies or problems still remain, which have limited the usefulness of the improved devices, as well as the effectiveness of the microphones which such devices support. For example, the frame work of some external shock mounting devices produce spurious resonance and secondary vibrations. Others of the improved devices are not sufficiently compliant to accommodate the dynamic vibration sensitivities incorporated in the more advanced microphones.

As another example, one popular shock mounting apparatus is designed and structured to completely surround the microphone being supported. However, because some microphones have on/off switches on the outer casing thereof, a mounting device that encircles the microphone body may in fact obstruct the microphone on/off switches by preventing access to the switches or render the microphone more difficult to remove from its intended supporting structure. In addition, when utilizing a conventional microphone mount, a user can not efficiently and quickly transfer a microphone so that it may be hand held, because such a transfer can not be made without temporary loss of the microphone operation. Further problems associated with conventional microphone supports or mounts, of the type set forth above, relate to the fact that many microphones have permanently attached cables which preclude their use in a mount which encircles the microphone casing and therefore requires the removal of the cable to enable the attachment of the microphone to the mount in the intended manner.

Other attempts to improve microphone mounting or supporting structures have resulted in a less complicated structural design, wherein the microphone is fixedly attached to a support by a clip. Therefore, the position or orientation of the microphone is determined by the orientation of the clip. Devices of this type may be further adapted to include orientation or alignment devices, which allow for the positioning or orientation of the microphone into an operative position. The microphone is thereby capable of being positioned such that it is oriented in a direction to accomplish maximum sensitivity relative to the sound source. Such devices have attempted to incorporate a directional effect so as to establish hands free duplex communication for the transmission of sound, which is devoid of feed back.

SUMMARY OF THE INVENTION

The present invention is directed to a mounting assembly for removably supporting a microphone in an operative position while concurrently facilitating the support of the microphone in relative acoustic isolation, so as to avoid noise generation and sound distortion which typically occurs as a result of physical contact or impact with a floor stand, desk stand, boom, etc. to which the microphone is attached. As will be explained in greater detail hereinafter, the mounting assembly of the present invention may also be initially packaged or made commercially available in a kit assembly comprising the various components which facilitate the support of the microphone in a versatile, acoustically isolated manner.

More specifically the mounting assembly of the present invention comprises a plurality of support assemblies selectively attachable to one another to define a plurality of different predetermined configurations. The particular configuration utilized or selected is dependent on the preferred position or orientation of the microphone during a performance, where sound amplification is desired or required. More specifically, each of the predetermined configurations is determinative of a different, preferred operative orientation of the microphone based, at least in part, on the physical conditions or environment associated with use of the microphone.

Each of the support assemblies include at least one elongated base member preferably having a multi-sided external surface configuration extending along at least a majority of its length. Further, each of the plurality of support assemblies include at least one but more preferably a plurality of connector members, wherein each connector member includes an internal socket having an interior surface configuration which substantially corresponds to a multi-sided exterior surface configuration of the aforementioned bases. By virtue of the cooperative structuring between the one or more connectors and the base members, the connectors may slide along the length of a corresponding base so as to allow for selective positioning of the connector and any component to which it is attached or connected. Further, the connectors are at least partially structured to facilitate interconnection of the plurality of support assemblies to one another, such that the plurality of support assemblies may be selectively arranged in any one of the plurality of different predetermined configurations so as to best position the microphone in a preferred, operative orientation while being utilized.

The plurality of support assemblies comprise but are not necessarily limited to a microphone support, a filter support, and an auxiliary support. The microphone support comprises at least two support members selectively positioned in spaced apart relation to one another along a corresponding base, wherein the support members are cooperatively structured to suspend or otherwise support the microphone in an acoustically isolated manner so as to reduce exposure of the microphone to external noise and reduce or eliminate sound distortion.

The filter support preferably comprises a plurality of bases which are movably interconnected to one another by one or more of the connectors so as to at least partially define an articulated construction. The filter support also includes the removable attachment of a filter assembly which, due at least in part to the articulated construction of the movably interconnected bases, may be selectively disposed in any one of a variety of different positions. The availability of these different positions allow the filter assembly to be oriented in a preferred, aligned and protective relation to the microphone, thereby facilitating the attenuation of high impact phonetic peaks to which the microphone may be exposed.

As set forth above the plurality of support assemblies may also include an auxiliary support which preferably, but not necessarily, serves to supportingly interconnect the microphone support and/or filter support to a floor stand, desk stand, boom or other somewhat conventional supporting structure which supports and positions the microphone during its use.

As indicated, the above noted operative components may be easily interconnected and removed from one another which facilitates their packaging and commercial presentation in a kit assembly. It is emphasized however that the kit assembly may include all or selected ones of the aforementioned operative components along with other associated objects, devices, etc. which are associated or used in combination with the mounting assembly of the present invention.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The present invention relates to a mounting assembly generally indicated as 10 and structured to be selectively disposed in any one of a plurality of different predetermined configurations, so as to position and support at least one microphone, generally indicated as 12, in a manner which suppresses noise and reduces and isolates the microphone from interference due to physical shock or contact. The mounting assembly 10 of the present invention may be removably supported on any one of a plurality of different support stands or structures, generally indicated as 14.

Figure 6:
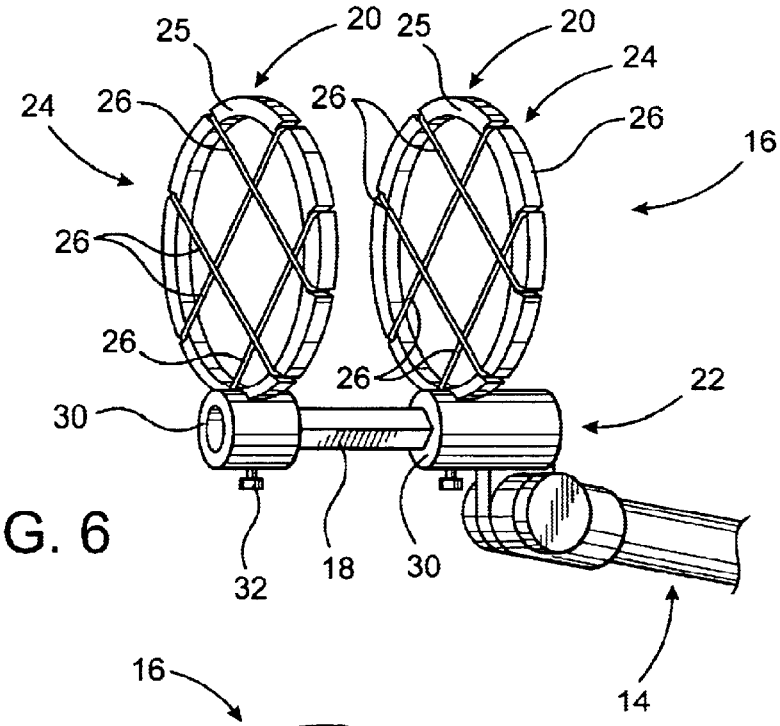
FIG. 6 is a perspective view of the embodiment of the microphone support assembly of the embodiment of FIGS. 1 and 2 oriented in a different predetermined configuration.
Figure 7:
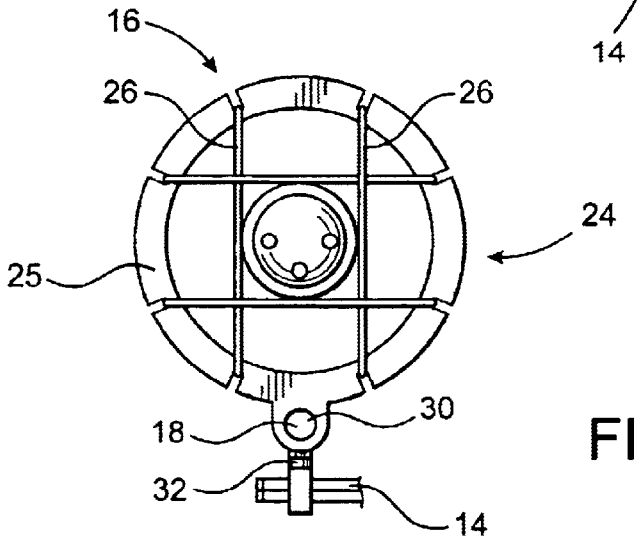
FIG. 7 is an end view of the embodiment of FIG. 6 with a microphone attached thereto.
Figure 8:
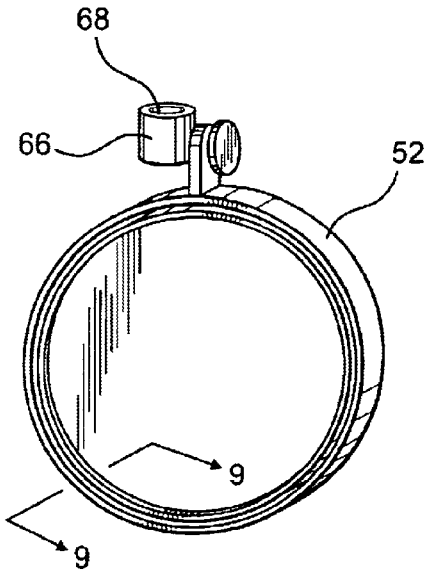
FIG. 8 is a perspective view of a portion of one embodiment of a filter assembly associated with the present invention.
Figure 9:
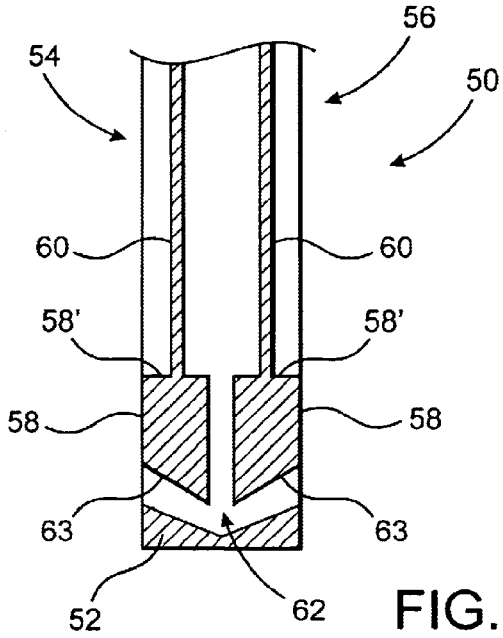
FIG. 9 is a sectional view in partial cutaway along line 9—9 of FIG. 8, showing structural features of one embodiment of the filter assembly of the present invention.
Figure 10:
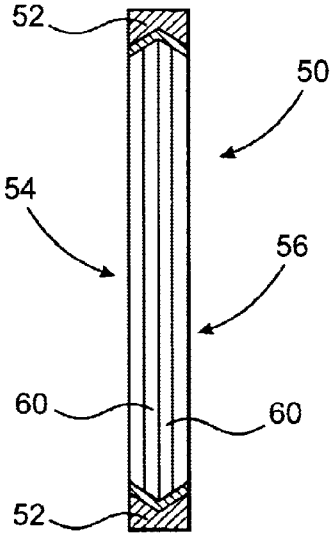
FIG. 10 is a longitudinal sectional view of one embodiment of the filter assembly shown in an assembled form.
Figure 11:
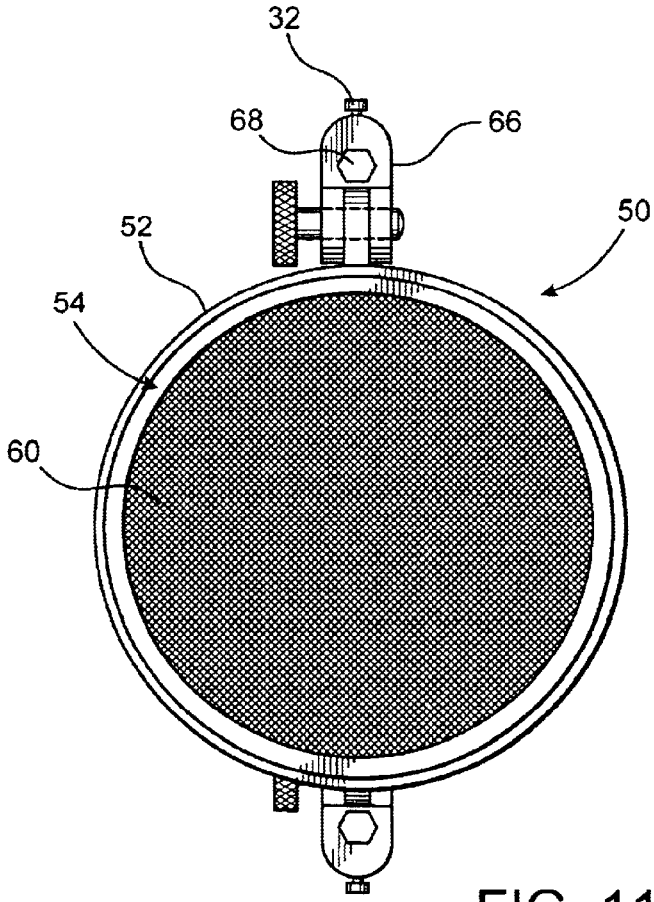
FIG. 11 is a front view of the embodiment of FIG. 10.

More specifically, the mounting assembly 10 comprises a plurality of support assemblies selectively attachable to one another to assume a variety of the aforementioned predetermined configurations. The operable orientation of the microphone 12 may of course vary dependent, at least in part on a particular use or performance in which the microphone 12 is involved. Accordingly, the plurality of support assemblies includes a microphone support 16 having an elongated base 18 and at least one but preferably two microphone supports 24 movably secured to the base 18 and shown in a different orientation in FIGS. 6 and 7. In addition, the microphone support assembly 16 includes at least one connector 22 movably connected to the base 18 and selectively positionable along the length thereof, as will be described in greater detail hereinafter. Moreover, the connector 22 is structured to be adjustably and removably attached to another connector, associated with a different one of the plurality of support assemblies, or to the stand or support structure 14. Frequently, a power or output cord 17 is connected to the microphone 12, although many modern day microphones no longer require the use of power or output cords 17. In any event, the microphone support assembly 16 includes at least one but preferably two microphone supports 24. each comprising a plurality of elongated elastic members 26 extending across a central opening of a surrounding, support frame 25. The elastic support members 26 are oriented in a overlapping or substantially "cris-cross" relation to one another. The microphone 12 will be suspended by the elastic members 26 within the central opening of the surrounding frame 25 in a manner which reduces interference or noise normally caused by physical shock or contact. As set forth above, each of the microphone supports 24 may be selectively disposed at preferred positions and preferably in spaced apart relation to one another along the base 18. This selective positioning is accomplished by connecting members 30 secured to each of the support frames 25 and including a hollow interior correspondingly configured and dimensioned with the exterior surface of the base 18, so as to slidingly receive the base 18 therein. As should be apparent, inadvertent rotation of the support members 24 relative to the base 18 is to be avoided. Therefore, the exterior surface configuration of base 18, and preferably each of the bases associated with the remainder of the plurality of support assemblies, as described in greater detailed hereinafter, preferably include a multi-sided configuration which prevents the inadvertent or free rotation of the connecting members 30 relative to the base 18. Further, in order to secure the relative position of the microphone support 24, a locking member 32 may pass through the outer wall of each of the connecting members 30 and into a frictional, locking engagement with an exterior surface the base 18. Similar locking structures are found on each of the plurality of support assemblies 16 associated with the mounting assembly 10 of the present invention.

Figure 3:
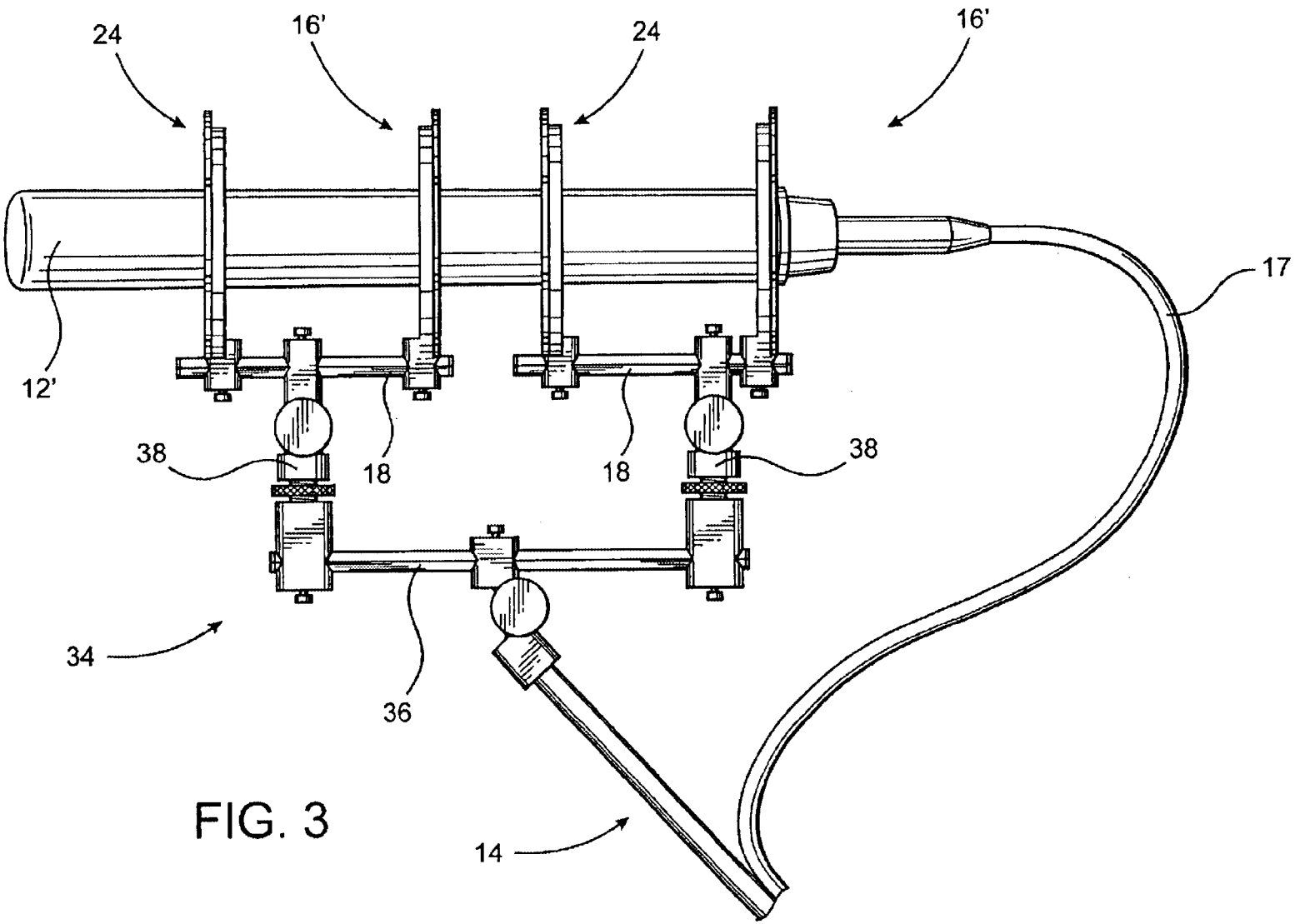
FIG. 3 is a perspective view of one embodiment of microphone support assembly which may be included in the embodiment of FIGS. 1 and 2.
Figure 4:
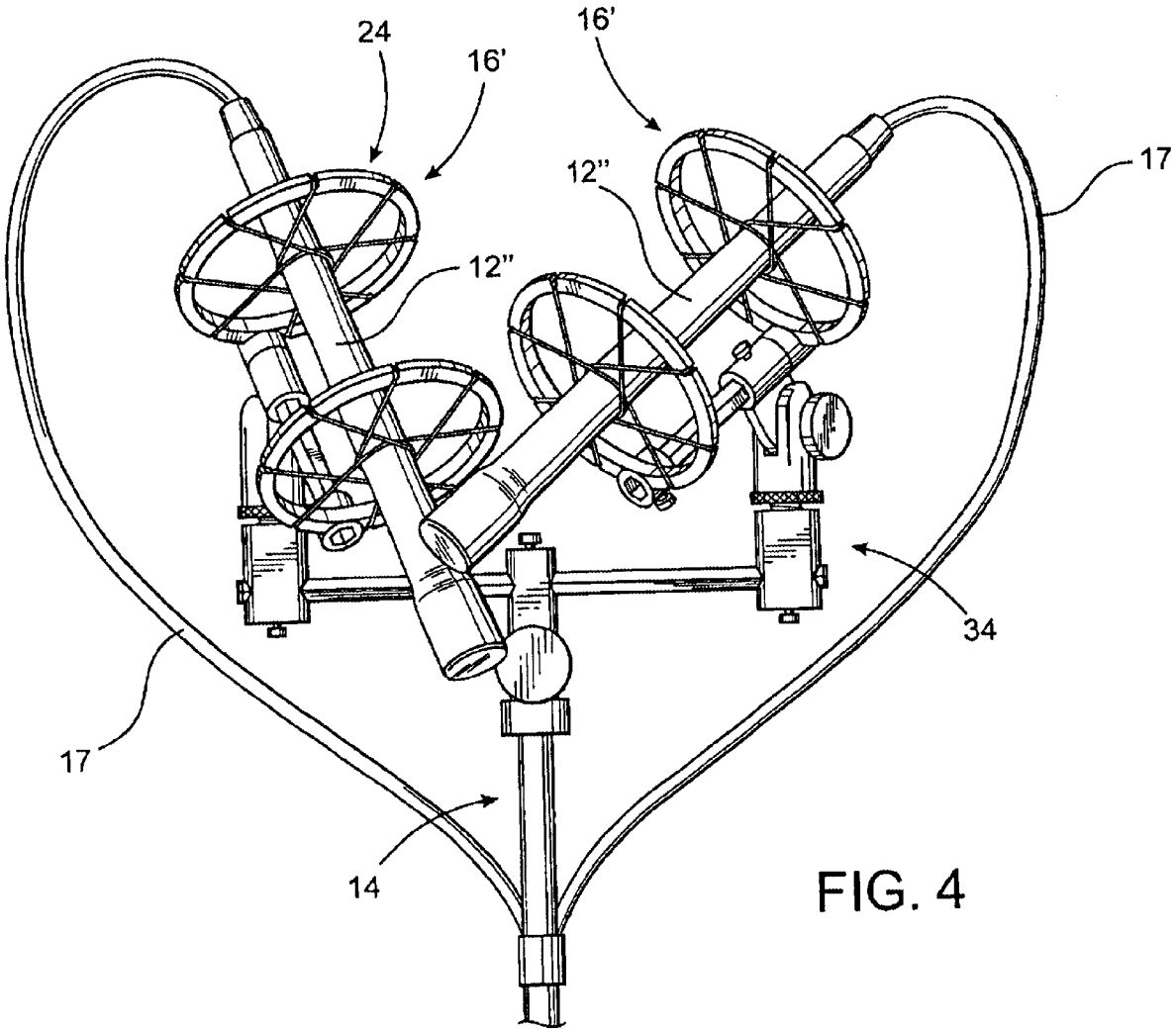
FIG. 4 is a perspective view of the embodiment of the microphone support assembly of FIG. 3 oriented in a different predetermined configuration which facilitates the support of two microphones.

As shown in FIGS. 3 and 4, the microphone support 16 may be used singularly or, depending upon specific microphone usage, may be used together with at least one other microphone support assembly, wherein the two microphone support assemblies are each indicated as 16'. One type of microphone 12' having an elongated configuration is suspended in a preferred, operable orientation by a plurality of microphone support members 24, of each microphone support assembly 16'. The microphone 12' is supportingly engaged at spaced apart portions along its length, by the individual support members 24. The microphone 12' thereby enjoys maximum noise suppression and shock resistance. Similarly, the predetermined orientation shown in FIG. 4 includes the concurrent support and suspension of two microphones 12" in the manner shown.

Figure 1:
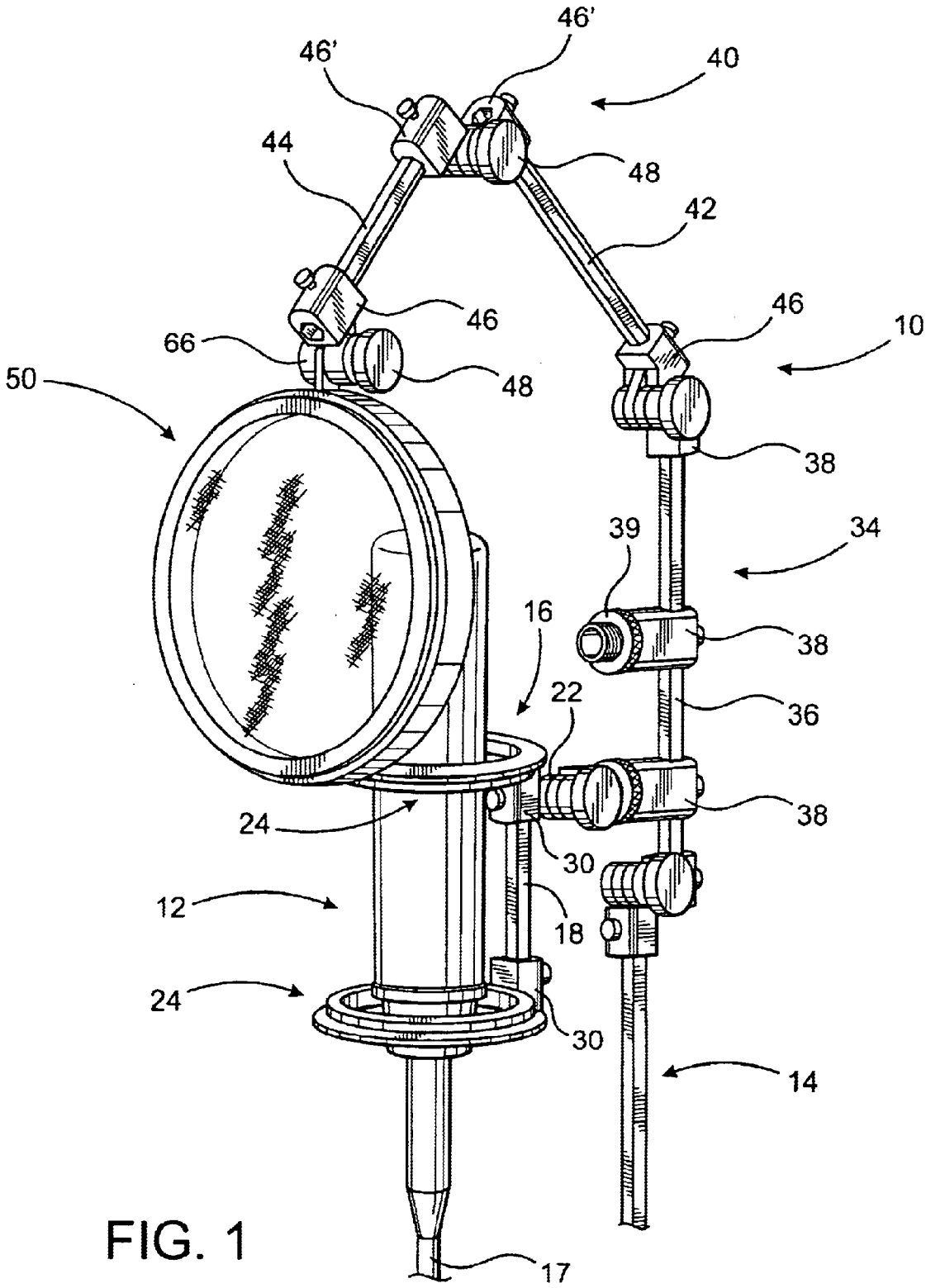
FIG. 1 is a perspective view of one embodiment of the mounting assembly of the present invention with a microphone removably supported in an operative position.
Figure 2:
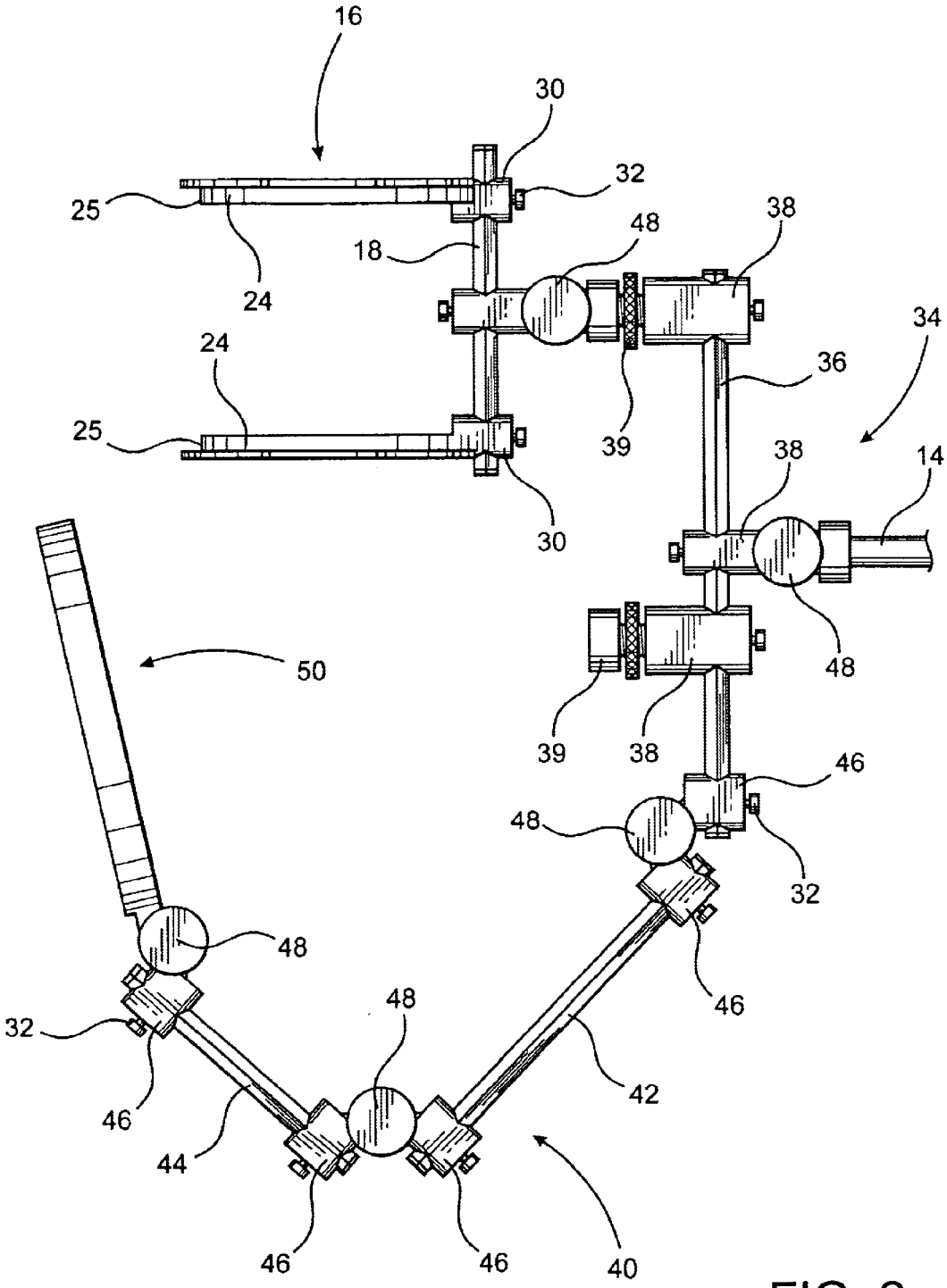
FIG. 2 is a side view of the mounting assembly of the embodiment of FIG. 1 oriented in a different predetermined configuration and being absent a microphone supported thereon.
Figure 5:
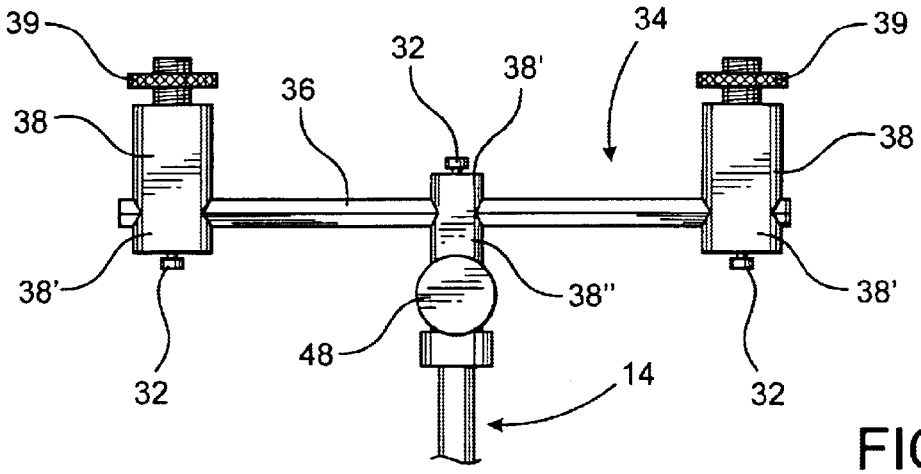
FIG. 5 is a perspective view of an auxiliary support assembly incorporated in the embodiment of FIGS. 1, 2, 3 and 4.

As also shown in FIGS. 3 and 4, the plurality of support assemblies 16' also include an auxiliary support assembly generally indicated as 34. The auxiliary support assembly 34 includes an elongated multi-sided base 36 having at least one but preferably two connectors 38 adjustably positioned along the length of the base 36, normally in spaced relation to one another. The connectors 38 may be secured in a preferred position relative to one another by a locking member 32, of the type discussed above. With further reference to FIG. 5, each of the connectors 38 may have a female attachment structure or connector as at 39 secured to one end and a receiving socket 38' with the locking member 32 secured to the opposite end for movable and selectively securable positioning on the base 36. The auxiliary support assembly 34 includes at least one additional connector 38" which may be movably mounted to facilitate attachment to any one of a plurality of support structures or stands 14. As shown in FIGS. 1 and 2 the mounting assembly 10 is oriented in predetermined, but different configurations dependent upon the operative orientation of the microphone 12 (not shown in FIG. 2). The versatility of the mounting assembly 10 is further emphasized by the fact that the connector 38 and the female connector 39, are available for connection to other support assemblies or associated components to define configurations other than that shown.

Also with reference to FIGS. 1 and 2 the plurality of support assemblies 16 further include a filter support assembly generally indicated as 40. The filter support assembly 40 includes two elongated bases 42 and 44 each of which may have the aforementioned multi-sided configuration and wherein the bases 42 and 44 may be of equal or different lengths. A plurality of connectors 46 are attached at various locations on the respective basis 42 and 44 and are structured to be secured to one another as at 46'. One or more adjustment knobs 48 allow pivotal movement or attachments of the connectors 46 and 46' to one another and to the filter assembly 50, to be described in greater detail hereinafter. The pivotal and/or adjustable interconnection of the connectors 46 and 46' allow for an articulated construction such that base 42 may be secured to another support assembly such as, but not limited to, the auxiliary support assembly 34 and may be adjustably positioned to dispose the filter assembly 50 in aligned, adjacent and protective relation to the microphone 12. When comparing FIGS. 1 and 2 it should be apparent that the microphone could of course be located in any of a wide variety of operative orientations. Accordingly, the versatility of the mounting assembly 10 provided, at least in part, by the variable interconnections of the plurality of support assemblies 16, 34 and 40, allow for the suspended support of at least one microphone 12 in a noise resistant manner, as well as allowing the filter assembly 50 to be positioned in its intended protective relation to the microphone 12.

With reference to FIGS. 8 through 11, the unique construction of the filter assembly 50 is the basis of it being identified as a "pop filter". More specifically, the filter assembly 50 includes a circular or annularly configured brace 52 removably secured into a closed configuration by a separable connector 66, having a receiving pocket or channel 68 formed therein. The brace 52 is attached to one of the bases 42 or 44 or connected to a correspondingly disposed connector 46 as described with relation to FIG. 1. Further, the interior surface generally indicated as 62 of the annular brace 52 comprises a substantially v-shape cross-sectional configuration, as best demonstrated in FIG. 8. Similarly, at least one but preferably two filter elements 54 and 56 each include an annular peripheral portion 58, formed of at least partially rigid material. Each of the peripheral portions 58 are secured continuously along a peripheral edge 58' of a filter material or diaphragm 60, extending across and effectively covering the central opening of the peripheral portion 58. The outer surface of each of the peripheral portion 58 has a beveled or annularly inclined surface configuration 63. Accordingly, when the filter assembly 50 is assembled in the intended manner, both the filter elements 54 and 56 are disposed in immediately adjacent, spaced relation to one another within the interior of the annular brace 52. However, each of the filter elements 54 and 56 can be easily removed or "popped" out of their assembled position for cleaning, replacement or repair. The cooperative configuration of the interior surface 62 of the brace 52 with the exterior surfaces .63 of the peripheral portions 58, provide for secure but removal mounting of each of the filter elements 54 and 56 in their assembled position within the brace 52. When so assembled the filter assembly 50 may be oriented in its protective disposition relative to the microphone 12 as explained above and as clearly shown in FIG. 1.

It is further emphasized that some or all of the plurality of support assemblies, as well as other complementary components which may be associated therewith, may be incorporated in a kit assembly, wherein such a kit assembly is included within the spirit and scope of the present invention.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A mounting assembly for a microphone, said mounting assembly comprising:

(a) a plurality of support assemblies selectively attachable to one another to assume a variety of predetermined configurations, (b) each of said predetermined configurations determinative of a preferred operative orientation of the microphone, (c) each of said support assemblies comprising at least one base and at least one connector, (d) at least some of said connectors removably attachable to one another to define an interconnection between corresponding bases of said plurality of support assemblies, (e) a filter support including a filter assembly, said filter assembly selectively positionable in adjacent substantially aligned relation to the microphone and wherein said filter assembly comprises a filter and a brace supporting and surrounding said filter which removably attaches to the mounting assembly; and (f) at least one of said support assemblies comprising a microphone support.

2. An assembly as recited in claim 1 wherein said microphone support comprises at least two support members disposed in spaced apart relation along a corresponding one of said bases and in supporting engagement with the microphone at spaced apart portions along the length thereof.

3. An assembly as recited in claim 2 wherein said support members are individually and cooperatively structured to position the microphone in a substantially suspended, centrally disposed orientation relative thereto.

4. An assembly as recited in claim 3 wherein each of said support members comprises a plurality of elastic members attached to a surrounding frame and collectively disposed in a transverse cris-crossing orientation relative to one another.

5. An assembly as recited in claim 4 wherein said plurality of elastic members and said frame of each of said support members are cooperatively structured to orient the microphone in perpendicular, substantially co-axial relation to said frame.

6. An assembly as recited in claim 2 wherein each of said support members comprises a noise suppressing construction.

7. An assembly as recited in claim 1 wherein at least one of said support assemblies comprises a plurality of bases movably interconnected to one another to define an articulated construction.

8. An assembly as recited in claim 7 wherein said one support assembly further comprises said filter assembly movably attached to one of said plurality of bases, said one support assembly movably attached to at least one other of said plurality of support assemblies.

9. An assembly as recited in claim 8 wherein said plurality of bases are adjustably attached to one another at correspondingly positioned ends thereof.

10. An assembly as recited in claim 9 wherein said filter assembly is pivotally connected to a free end of one of said plurality of bases and said one other of said support assemblies pivotally connected to a free end of one other of said bases.

11. An assembly as recited in claim 1 wherein each of said bases are elongated and comprise a multi-sided exterior surface configuration extending along at least a majority of the length thereof.

12. An assembly as recited in claim 11 wherein each of said connectors includes a receiving socket comprising a multi-sided interior surface configuration.

13. An assembly as recited in claim 12 wherein said interior surface of each of said connectors and said exterior surface of each of said bases are correspondingly dimensioned, configured and disposed for sliding engagement with one another.

14. An assembly as recited in claim 13 wherein each of said connectors are mounted on a corresponding one of said bases in a non-rotating manner.

15. An assembly as recited in claim 11 wherein at least some of said plurality of support assemblies comprise said connector slidably positionable along a length thereof.

16. An assembly as recited in claim 1 wherein at least one of said support assemblies comprises an elongated base and a plurality of connectors movable relative to one another along the length of said base.

17. An assembly as recited in claim 16 wherein said elongated base comprises a multi-sided exterior surface configuration extending along at least the majority of the length thereof.

18. An assembly as recited in claim 17 wherein each of said connectors includes a receiving socket comprising a multi-sided interior surface configuration.

19. A mounting assembly removably supporting a microphone in an operative position, said assembly comprising:

(a) a plurality of support assemblies selectively attachable to one another to assume a variety of predetermined configurations, (b) each of said predetermined configurations determinative of a preferred operative orientation of the microphone, (c) said plurality of support assemblies at least including a microphone support, (d) said microphone support structured to removably support a microphone in an operable, shock resistant orientation, and (e) a filter support structured to adjustably support a filter assembly in a substantially aligned, protective relation to the microphone and wherein said filter assembly comprises a filter and a brace supporting and surrounding said filter which removably attaches to the mounting assembly.

20. An assembly as recited in claim 19 wherein said filter assembly includes a frame and at least one filter element movably secured to said frame.

21. An assembly as recited in claim 20 wherein said filter assembly comprises at least two filter elements disposed in spaced, substantially parallel relation to one another, said frame disposed in removable, surrounding engagement with said filter elements.

22. An assembly as recited in claim 20 wherein said filter support assembly comprises a plurality of bases movably interconnected to define an articulated construction.

23. An assembly as recited in claim 22 wherein said microphone support comprises an elongated base and at least two support members selectively positionable along said base in spaced, substantially parallel relation to one another.

24. An assembly as recited in claim 23 wherein each of said support members comprises a noise suppressing construction, said noise suppressing construction at least partially defined by an exterior, circumferential frame and a plurality of elastic members collectively disposed in a cris-crossed orientation with one another substantially co-planar to said frame.

25. A mounting assembly for removably supporting a microphone in an operative position, said assembly comprising:

a) a microphone support structured to removably support the microphone in an operative, shock resistant orientation, b) a filter support connected to said microphone support and structured to adjustably support a filter assembly in substantially aligned, protective relation to the microphone and wherein said filter assembly comprises a filter and a brace supporting and surrounding said filter which removably attaches to the mounting assembly, c) an auxiliary support removably and adjustably attached in supporting relation to at least one of said filter support or microphone support, d) each of said microphone, filter and auxiliary supports comprising at least one elongated base and at least one connector movably mounted thereon, and e) said connectors disposed in interconnecting relation to said bases to assume anyone of a plurality of predetermined configurations and a selective operative orientation of the microphone.

26. An assembly as recited in claim 25 wherein each of said bases comprises an elongated configuration and a multi-sided exterior surface configuration extending along at least a majority of the length thereof.

27. An assembly as recited in claim 26 wherein each of said connectors include a receiving socket comprising a multi-sided interior surface configuration; said interior surface and said exterior surface configurations being correspondingly dimensioned and configured for sliding engagement with one another.

* * * * *